US009551053B2

(12) United States Patent
Kononenko et al.

(10) Patent No.: US 9,551,053 B2
(45) Date of Patent: Jan. 24, 2017

(54) METHOD FOR LIMITING SURFACE RECRYSTALLIZATION

(75) Inventors: Yuriy G. Kononenko, Kyiv (UA); Igor V. Belousov, Kyiv (UA); Vadim Ivanovich Bondarchuk, Kiev (UA); Andrii Marynskyi, Kyiv (UA); Carl R. Soderberg, Kyiv (UA)

(73) Assignee: United Technologies Corporation, Hartford, CT (US)

( * ) Notice: Subject to any disclaimer, the term of this patent is extended or adjusted under 35 U.S.C. 154(b) by 1220 days.

(21) Appl. No.: 13/167,233

(22) Filed: Jun. 23, 2011

(65) Prior Publication Data

US 2012/0328903 A1 Dec. 27, 2012

(51) Int. Cl.

| | |
|---|---|
| ***C22C 19/05*** | (2006.01) |
| ***C22F 1/10*** | (2006.01) |
| ***C22F 1/00*** | (2006.01) |
| ***C22C 19/03*** | (2006.01) |
| ***C22C 19/07*** | (2006.01) |

(52) U.S. Cl.

CPC ..... *C22F 1/00* (2013.01); *C22C 19/03* (2013.01); *C22C 19/05* (2013.01); *C22C 19/051* (2013.01); *C22C 19/057* (2013.01); *C22C 19/07* (2013.01); *C22F 1/10* (2013.01); *C21D 2201/04* (2013.01); *Y10T 428/12944* (2015.01)

(58) Field of Classification Search

CPC ..... C22C 19/03; C22C 19/05; C22C 19/051; C22C 19/052; C22C 19/053; C22C 19/055; C22C 19/056; C22C 19/057; C22C 19/058; C22F 1/10

USPC ..... 148/677

See application file for complete search history.

(56) References Cited

U.S. PATENT DOCUMENTS

| | | | | |
|---|---|---|---|---|
| 2,921,878 | A | 1/1960 | Aspden et al. | |
| 3,660,177 | A | 5/1972 | Brown et al. | |
| 4,475,980 | A | 10/1984 | Rhemer et al. | |
| 4,895,201 | A * | 1/1990 | DeCrescente et al. | 75/628 |
| 5,534,085 | A | 7/1996 | Cone et al. | |
| 5,598,968 | A | 2/1997 | Schaeffer et al. | |
| 7,442,225 | B2 | 10/2008 | Takada et al. | |
| 2003/0062099 | A1 | 4/2003 | Buergel et al. | |
| 2004/0007296 | A1 | 1/2004 | Mihalisin et al. | |
| 2010/0163142 | A1 | 7/2010 | Ott et al. | |

FOREIGN PATENT DOCUMENTS

| | | |
|---|---|---|
| EP | 2322681 | 5/2011 |
| WO | 9921681 | 5/1999 |

OTHER PUBLICATIONS

Li, M. H., et al. "Oxidation Behavior of a Single-Crystal Ni-Base Superalloy in Air. I: At 800 and 900 C." Oxidation of Metals 59.5-6 (2003) pp. 591-605.*

European Search Report for European Application No. 12173006. 3-1215 completed on Nov. 9, 2012.

R. Burgel, P.D. Portella, J. Preuhs: "Recrystallizatoin in single crystals of nickel base superalloys", Superalloys 2000 [Online] Jan. 1, 2000 pp. 229-238 XP002686745. Retrieved from the Internet: URL: http://www.tms.org/superalloys/10.7449/2000/Superalloys_2000_229_238.pdf.

* cited by examiner

*Primary Examiner* — Jessee Roe

(74) *Attorney, Agent, or Firm* — Carlson, Gaskey & Olds, P.C.

(57) ABSTRACT

A method to limit surface zone recrystallization in a superalloy article includes limiting recrystallization in a surface zone of a superalloy article by treating the superalloy article in an oxygen-containing environment to introduce oxygen into the surface zone in an amount sufficient to pin any new grain boundaries in the surface zone.

11 Claims, 4 Drawing Sheets

20

METHOD FOR LIMITING SURFACE RECRYSTALLIZATION

BACKGROUND

This disclosure relates to superalloy components, such as components that are used in turbine engines.

Superalloy materials, such as nickel or cobalt-based superalloys, are known and used to fabricate components that are subject to severe operating environments. As an example, airfoils that are used in the high temperature section of gas turbine engines may be made of superalloy material. The superalloy material is typically cast into the desired shape and subjected to post-cast processing steps, such as grinding, polishing and grit blasting, to finish the component.

SUMMARY

Disclosed is a method to limit surface zone recrystallization in a superalloy article. The method includes limiting recrystallization in a surface zone of a superalloy article by treating the superalloy article in an oxygen-containing environment to introduce oxygen into the surface zone in an amount sufficient to pin any new grain boundaries in the surface zone. In an embodiment, the recrystallization that occurs under a recrystallization condition of 1080° C./1976° F. for 4 hours is limited by first treating the superalloy article in an oxygen-containing environment at a treatment temperature of 800-900° C./1472-1652° F. to introduce the oxygen into the surface zone.

Also disclosed is a superalloy article that includes a superalloy body that has a surface zone. The surface zone includes oxygen in an amount sufficient to pin any new grain boundaries in the surface zone that occur under a recrystallization condition of 1080° C./1976° F. for 4 hours.

The various features and advantages of the disclosed examples will become apparent to those skilled in the art from the following detailed description. The drawings that accompany the detailed description can be briefly described as follows.

DETAILED DESCRIPTION

Figure 1:
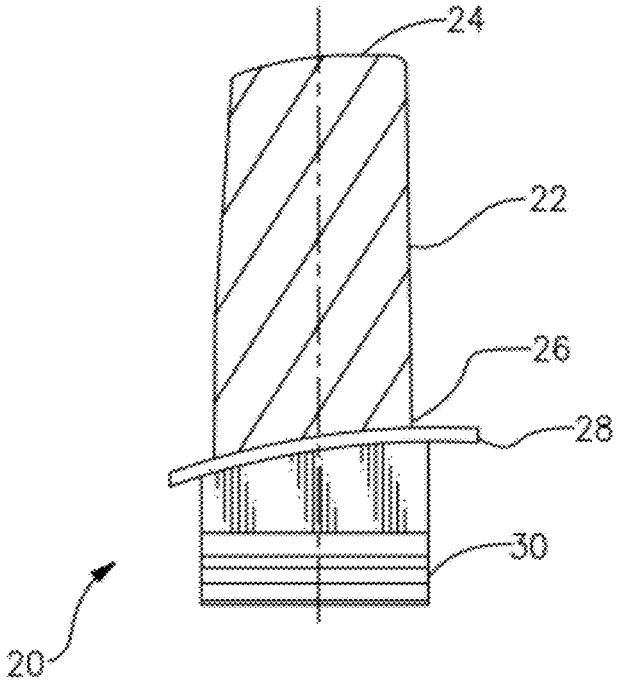
FIG. 1 shows an example superalloy article.

FIG. 1 illustrates selected portions of an example superalloy article 20. In the illustrated example, the superalloy article 20 is a blade for a gas turbine engine. It is to be understood, however, that the superalloy article 20 is not limited to blades, and other superalloy articles will benefit from the examples disclosed herein.

In the illustrated example, the superalloy article 20 generally includes a blade section 22 that extends between a tip 24 and a base 26. The base 26 is connected to a platform 28 and root portion 30 for securing the compressor blade within an engine.

The superalloy article 20 is formed from a superalloy material, such as by casting the superalloy material into the shape of the blade or other article. In some examples, the superalloy material is a nickel-based or cobalt-based superalloy material, such as, but not limited to HASTELLOY, INCONEL, NIMONIC, Waspaloy, Rene alloys, HAYNES alloys, INCOLOY, or single crystal alloys.

In one example, the superalloy article 20 is a single-crystal, nickel-based superalloy. In a further example, the single-crystal, nickel-based superalloy has a nominal composition of 6.5 wt. % chromium, 9 wt. % cobalt, 0.6 wt. % molybdenum, 3 wt. % rhenium, 6 wt. % tungsten, 5.6 wt. % aluminum, 1 wt. % titanium, 6.5 wt. % tantalum, 0.1 wt. % hafnium and a balance of nickel and any incidental impurities.

The superalloy article 20 is subjected to post-solidification processing steps, such as grinding, polishing and grit blasting, to finish the superalloy article 20. Such processing steps can produce residual stresses and/or increased defect density in the microstructure of the superalloy material of the superalloy article 20. Residual stress and/or increased defect density promotes recrystallization in the surface of a superalloy material upon exposure to elevated temperatures in subsequent processing steps, and particularly when the temperature exceeds the gamma prime phase solvus temperature.

For the superalloy article 20, recrystallization at the surface debits creep and fatigue performance and can increase oxidation. Creep rupture life can be reduced by up to a 50%. The reduction in creep performance is thought to be a result of easier slip propagation in the recrystallized areas from a higher amount of slip systems favorably oriented relative to applied stresses, and to the degradation of the gamma prime distribution. Additionally, the grain boundaries of the recrystallized areas are also initiation points for void formation during creep, especially in the alloys of the last generations, in which content of so-called grain boundary strengthening elements (Zr, B, C) is low. In some examples, creep failure can also initiate at the interface between the recrystallized area and the single crystal because of the different stiffness between the recrystallized area and the single crystal and precipitation compounds present along the interface. The oxidation rate increases because of oxygen diffusion along the recrystallized grain boundaries. As will be described in further detail, the superalloy article 20 has been treated according to the disclosed method in order to limit surface recrystallization that might otherwise occur under recrystallization conditions. That is, the described treatment effectively increases the surface zone recrystallization temperature by doping the surface zone with an oxygen dopant.

Figure 2:
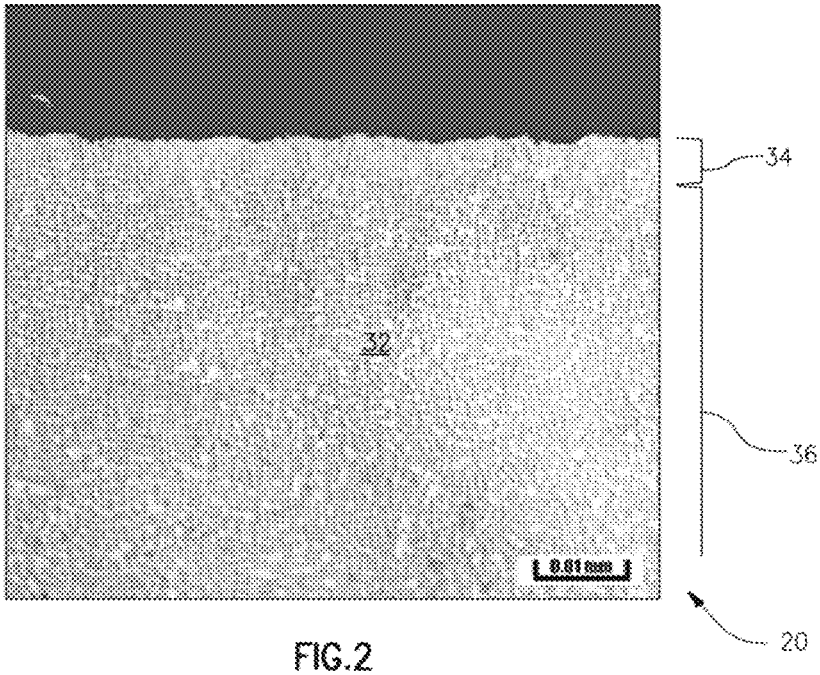
FIG. 2 shows a microstructure of a superalloy material after treatment according to the disclosed method followed by conditioning under a recrystallization condition.

FIG. 2 shows a cross-section through a portion of the superalloy article 20 that is metallographically prepared to reveal the microstructure of the superalloy material. As shown, the superalloy article 20 includes a superalloy body 32 that has a surface zone 34 and a subsurface zone 36 below the surface zone 34. That is, the surface zone 34 includes a free surface that is directly exposed to the surrounding environment of the superalloy article 20 and a portion that extend below the free surface. The subsurface zone 36 is beneath the surface zone 34 and is not directly exposed to the surrounding environment.

Through the disclosed method that will be described below, the surface zone 34 includes an oxygen dopant in an amount sufficient to pin any new grain boundaries in the surface zone 34 that occur under a recrystallization condition of 1080° C./1976° F. for 4 hours. The amount of oxygen dopant that is needed to pin grain boundaries is a function of the material composition, treatment temperature to introduce the oxygen and level of mechanical stress at the surface zone 34 (e.g., from machining grit blasting, etc.), which, with the teachings of this disclosure, can all be easily experimentally determined.

In comparison, the subsurface zone 36 includes less oxygen than the surface zone 34. The amount of oxygen within the surface zone 34, however, is not so high as to produce a continuous oxide scale on the surface of the superalloy article 20. That is, the oxygen is in solution (doped) within the microstructure of the superalloy material and/or forms fine oxide compounds that are discrete, discontinuous phases within the surface zone 34. Additionally, the amount of oxygen is not so high as to deplete the superalloy material of gamma prime phase 38. As an example, the amount of gamma prime phase 38 in the subsurface zone 36 in terms of volume percentage is equal before and after the introduction of oxygen into the surface zone 34.

Turning now to the disclosed method of treatment, the superalloy article 20 is treated in an oxygen-containing environment to introduce, or dope, the oxygen into the surface zone 34 in an amount sufficient to pin any new grain boundaries in the surface zone 34 to thereby limit recrystallization in the surface zone 34. In general, recrystallization occurs at a lower temperature in the surface zone 34 than in the subsurface zone 36, because of mechanical stress in the surface zone 34. That is, the surface zone 34 has a lower recrystallization temperature than the subsurface zone 36. The oxygen dopant effectively raises the recytallization temperature of the surface zone 34 to thereby limit recystallization. However, the recrystallization temperature of the surface zone may still be lower than the recrystallization temperature of the subsurface zone 36.

As an example, the superalloy article 20 is treated in air at a treatment temperature of 800-900° C./1472-1652° F. for two hours, although the time and temperature within the given range, and optionally pressure, can be varied depending on the composition of the superalloy material and processing history of the superalloy material with regard to mechanical processing. The treatment introduces oxygen into the surface zone 34, but not in such a high amount as to deplete the gamma prime phase 38 in the underlying subsurface zone 36. That is, the selected conditions for the disclosed method are insufficient for recrystallization and excessive oxidation. The treatment temperature is therefore lower than the recrystallization temperature of the surface zone 34, which as described above is lower than the recrystallization temperature of the subsurface zone 36.

Figure 3:
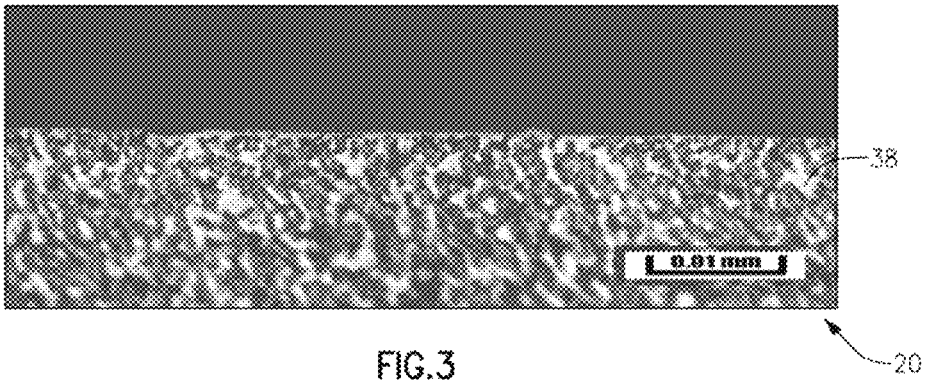
FIG. 3 shows an initial microstructure of a superalloy material after formation of the article.
Figure 4:
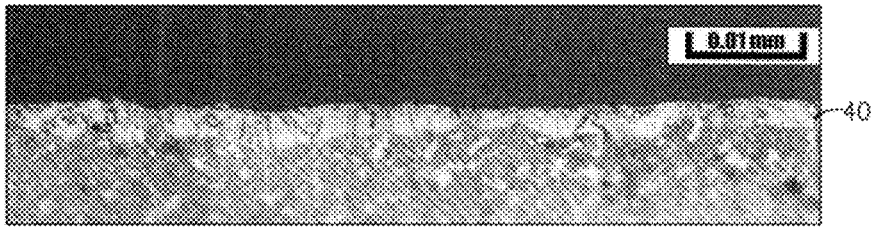
FIG. 4 shows a comparative microstructure of a superalloy material after annealing under a recrystallization condition and without treatment according to the disclosed method.

The following examples show microstructures of a superalloy material according to the disclosed method of treatment in comparison to microstructures of the same nominal composition of superalloy material for comparative treatments to show the effectiveness of the disclosed method. FIG. 3 shows a microstructure of the superalloy material prior to any treatments, and FIG. 4 shows an example of the microstructure of the superalloy material after annealing at 1080° C./1976° F. for 4 hours under a pressure of $10^{-3}$ Pascals, in which the microstructure forms a recrystallized layer 40.

Figure 5:
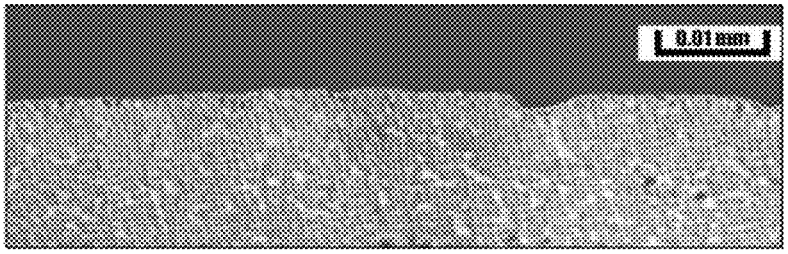
FIG. 5 illustrates a comparative microstructure of a superalloy material after an annealing step.

In a further comparative example shown in FIG. 5, the superalloy material was annealed at a temperature of 870° -1040° C./1598-1904° F. for 3 hours under a pressure of $10^{-3}$ Pascals (vacuum condition), after which no recrystallization was evident.

Figure 6:
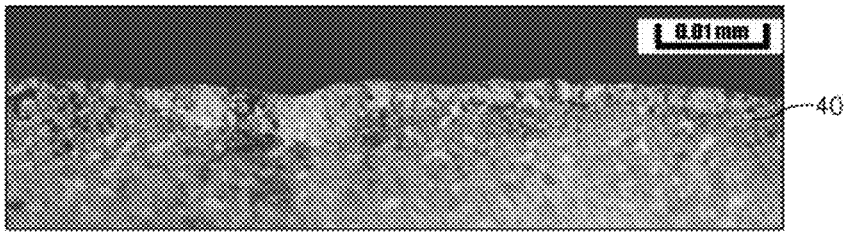
FIG. 6 illustrates a comparative microstructure of a superalloy material after the annealing of FIG. 5 followed by treatment under a recrystallization condition.

The sample was then treated under the recrystallization condition of 1080° C./1976° F. for 4 hours. As shown in FIG. 6, the recrystallization condition formed the recrystallization layer 40 on the sample, which indicates that annealing at sub-recrystallization temperatures under vacuum is generally ineffective to reduce recrystallization.

Figure 7:
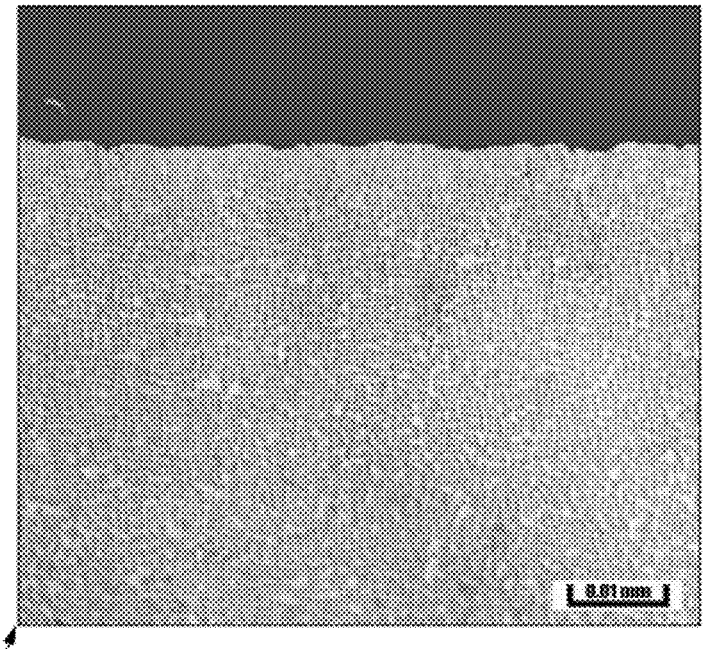
FIG. 7 shows a microstructure of a superalloy material after treatment according to the disclosed method at 800° C./1472° F. for two hours in air.

FIG. 7 shows the microstructure of the superalloy material of the superalloy article 20 after treatment at 800° C./1472° F. for 2 hours in air. No recrystallization layer is evident. The superalloy article 20 was then subjected to the recrystallization condition of 1080° C./1976° F. for 4 hours under a pressure of $10^{-3}$ Pascals. As shown in FIG. 2, there is no recrystallization in the surface zone 34. Thus, the prior treatment at 800° C./1472° F. for 2 hours in air to introduce oxygen into the surface zone 34 limited the formation of a recrystallized layer at the recrystallization condition of 1080° C./1976° F. for 4 hours. The same result is expected over the range 800-900° C./1472-1652° F. for 2 hours in air.

In a further example, portions of the superalloy article 20 that are not to be treated may be masked to block oxygen from infiltrating into the superalloy material. As an example, the blade section 22 of the superalloy article 20 may be masked, as shown by the cross-hatched lines in FIG. 1. In such an example, the more complex shape of the root portion 30 is treated but the blade section 22 is not. Alternatively, portions that are less prone to recrystallization, such as areas with low residual stress and/or low defect density, are masked off to prevent oxygen from infiltrating where the disclosed treatment is unneeded.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A superalloy article comprising:

a nickel-based superalloy body that has a surface zone, the surface zone including oxygen dopant in an amount sufficient to pin any new grain boundaries in the surface zone that occur under a recrystallization condition of 1080° C./1976° F. for 4 hours, the amount of oxygen dopant being insufficient to produce a continuous oxide scale on the surface of the nickel-based superalloy body.

2. The superalloy article as recited in claim 1, wherein the superalloy body includes a subsurface zone under the surface zone, and the subsurface zone includes less oxygen than the surface zone.

3. The superalloy article as recited in claim 1, wherein the nickel-based superalloy body is a single-crystal nickel-based superalloy.

4. The superalloy article as recited in claim 1, wherein the nickel-based superalloy has a nominal composition of 6.5 wt % chromium, 9 wt % cobalt, 0.6 wt % molybdenum, 3 wt % rhenium, 6 wt % tungsten, 5.6 wt % aluminum, 1 wt % titanium, 6.5 wt % tantalum, 0.1 wt % hafnium, and a balance of nickel and any impurities.

5. The superalloy article as recited in claim 1, wherein the oxygen dopant is in solution within the microstructure of the surface zone.

6. The superalloy article as recited in claim 1, wherein the amount of oxygen dopant is insufficient to deplete the superalloy article of gamma prime phase.

7. The superalloy article as recited in claim 1, wherein a recrystallization temperature of the surface zone is lower than a recrystallization temperature of a subsurface zone under the surface zone.

8. The superalloy article as recited in claim 1, wherein an area of the surface zone includes the oxygen dopant and another area of the surface zone excludes oxygen dopant.

9. The superalloy article as recited in claim 8, wherein the area that excludes oxygen dopant has low residual stress relative to the area having oxygen dopant.

10. The superalloy article as recited in claim 8, wherein the area that excludes oxygen dopant has low defect density relative to the area having oxygen dopant.

11. The superalloy article as recited in claim 8, wherein the superalloy body is an airfoil having a root portion and a blade portion connected to the root portion, and the area having oxygen dopant is the root portion and the area that excludes oxygen dopant is the blade portion.

* * * * *